US005327109A

United States Patent [19]

Hoang et al.

[11] Patent Number: 5,327,109

[45] Date of Patent: Jul. 5, 1994

[54] BLOCK FILTER HAVING HIGH-SIDE PASSBAND TRANSFER FUNCTION ZEROES

[75] Inventors: Truc G. Hoang, San Diego, Calif.; Reddy R. Vangala; Frederick L. Sassin, both of Albuquerque, N. Mex.

[73] Assignee: Motorola, Inc., Schaumburg, Ill.

[21] Appl. No.: 971,387

[22] Filed: Nov. 4, 1992

[51] Int. Cl.[5] ..... H01P 1/205

[52] U.S. Cl. ..... 333/206; 333/202

[58] Field of Search ..... 333/202, 206, 207, 222, 333/223, 235

[56] References Cited

U.S. PATENT DOCUMENTS

| | | | |
|---|---|---|---|
| 4,506,241 | 3/1985 | Makimoto et al. | 333/222 |
| 4,733,208 | 3/1988 | Ishikawa et al. | 333/206 X |
| 4,937,542 | 6/1990 | Nakatuka | 333/202 |
| 4,985,690 | 1/1991 | Eguchi et al. | 333/222 |
| 5,208,568 | 5/1993 | Sassin | 333/207 X |

FOREIGN PATENT DOCUMENTS

| | | | |
|---|---|---|---|
| 0043904 | 2/1987 | Japan | 333/202 |
| 0187901 | 8/1988 | Japan | 333/202 |

*Primary Examiner*—Seungsook Ham

*Attorney, Agent, or Firm*—Gary J. Cunningham; Joseph P. Krause

[57] ABSTRACT

A ceramic bandpass filter (10) that has transmission zeroes above the passband is accomplished without using the top patterning by a block structure that includes a localized mesa (26) formed at the top end of the block that provides increased capacitive coupling between the open circuits and the resonators (30, 32, and 34). This increased top end capacitance provided by the mesa (26) can provide high end or high side transmission zeroes to the characteristic transfer function of the filter.

7 Claims, 1 Drawing Sheet

BLOCK FILTER HAVING HIGH-SIDE PASSBAND TRANSFER FUNCTION ZEROES

FIELD OF THE INVENTION

This invention relates to electrical filters. More particularly, this invention relates to ceramic block filters.

BACKGROUND OF THE INVENTION

Ceramic block filters are well known in the prior art. As these devices have evolved and their use in radio communications products has increased, the electrical performance characteristics required of them have become increasingly more stringent.

In many radio communications applications, a ceramic bandpass filter may not have a passband cutoff characteristic that is sufficiently steep, particularly above the passband frequency. While most prior art ceramic bandpass filters have a relatively sharp cutoff frequency below the passband, most have a relatively mild cutoff characteristic above the passband. A sharper cut-off characteristic above the passband can be achieved by a so-called transmission zero above the passband. (A transmission zero in the transfer function of a filter that is a mathematical term representing a physical characteristic of the filter. A transmission zero is usually a combination of a capacitive element connected in parallel with an inductive element, which is positioned in the signal path such that it will block signals of a particular frequency and pass signals within the passband. A transmission zero above the passband is called herein a high-side transmission zero.) Since many communications applications could benefit from a ceramic bandpass filter having a so-called high side transmission zero, a ceramic block filter that has an increased attenuation above the bandpass for these applications would be an improvement over the prior art.

In the prior art, these so-called high side zeroes are accomplished principally by so-called top patterning or top loading. This top patterning is well known in the art and is essentially comprised of patterns of conductive material that surround the metallized holes of a block filter and in part capacitively couples signals to ground metallization lining the block filter, at some frequency. These patterns are accomplished principally by screen printing conductive material onto the top of the block. Top patterning is difficult to precisely control and does not lend itself readily to batch tuning, a tuning process whereby many block filters are preferably tuned in the manufacturing process, and not individually.

Accordingly, a ceramic block filter that has or accomplishes so-called high side transmission zeroes that increase attenuation of undesired signals above the passband frequency and one that avoids the prior art problems of top pattern tuning, would be an improvement over the prior art.

DESCRIPTION OF A PREFERRED EMBODIMENT

Figure 1:
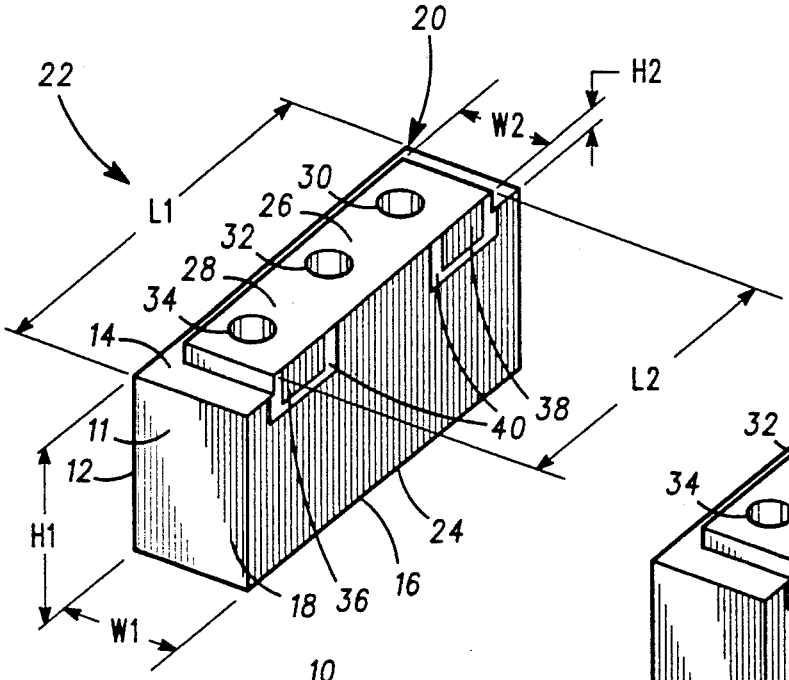
FIG. 1 discloses a perspective view of a ceramic block filter having high side transmission zeroes without using top patterning.

FIG. 1 shows a perspective view of a so-called side step ceramic block filter (10) that provides transmission zeroes in the transfer function of the filter above the passband frequency of the filter, (high-side zeroes) without the use of top patterning. The block filter (10) is comprised of a substantially rectangular block of ceramic material pressed before firing to include a mesa (26), the top of which (28) remains unmetallized. The block shown in FIG. 1 (12) can be considered as having two portions, a lower, substantially rectangular portion and a second, upper rectangular portion forming the mesa (26).

The lower portion of the block (10), namely the section having the height H1, can be considered as having itself, a top surface (14), and side surfaces (16, 18, 20 22) as well as a bottom surface (24). The bottom or lower portion of the block resembles a parallelepiped. The substantially parallelepiped-shaped mesa (26) that is comprised and formed of the ceramic material, is located on the first top surface (14) of the lower portion of the block. It can be seen that the mesa (26) itself has a height H2, a width W2, and a length L2. It is obvious from FIG. 1 that the height H2 is less than H1, that the width W2 is less than W1, and that the length L2 is less than L1.

As is true with all ceramic block filters, there is at least two holes, and in FIG. 1 there are shown 3 holes (30, 32, and 34), which extend completely through the block and extend through the mesa (26). In addition to its own side surfaces, the mesa (26) also has its own top surface forming the second top surface (28) of the filter.

A metallization layer (11), which is a layer of electrically conductive material, coats all of the exterior surfaces of the block excluding the top surface of the mesa (28). Metallization lines the surfaces of the holes (30, 32, and 34), which metallization is electrically coupled to the metallization lining the exterior surfaces of the block at the bottom or lower surface (24) of the block.

This metallization lining the holes in combination with the metallization lining the exterior surfaces of the block form lengths of transmission line open at the top surface (28) end but shorted to ground at the lower or bottom surface (24). At some particular frequency, these metallized holes in combination with the metallization lining of the block will form lengths of transmission line shorted at one end, the frequency of which is the frequency at which the electrical lengths are equal to a half wavelength or quarter wavelength as the case may be.

Signals are coupled into and out of these transmission line elements by means of input/output pads or contact surfaces (36 and 38) that are located on one side (16) of the block filter (10). These input/output pads (36 and 38) are essentially metallized areas isolated from the exterior metallization by means of cutback or areas from which the metallization is removed and identified by reference numeral (40). Alternatively, the unmetallized areas surrounding the input-output pads (36 and 38) might be accomplished using a resist material that prevents the metallization material from adhering to the block in areas around the location of the input-output pads.

It can be seen in FIG. 1 that the mesa (26) on the first top surface (14), having a width W2 less than W1 and a length L2 less than L1, forms thereby, steps, or recesses in the sides (16, 18, 20 and 22) of the block filter (10). These recessed areas located in the sides of the filter block, which recessed areas are considered to be side steps, when they are metallized, create ground walls on the sides of the mesa that are parallel to the metallization lining the resonator holes. The metallization on the sides of the mesa and the metallization of the holes form capacitors. These capacitors, which are proximate to and are substantially at the top end of the holes create capacitances that generate the zeroes to the filters passband characteristic which zeroes are above the passband frequency of the filter.

The mesa structure (26) as such replaces the printed patterning formerly used on the top surface of the block filter to produce higher value capacitances between the open circuit end of the holes (30, 32, and 34) and the grounded metallization lining the exterior surfaces of the block. The dimensions of the side-step that comprises the mesas (26) are relatively easy to control during the manufacturing process, are very symmetrical, and lends the filter to batch tuning after firing and metallization by means of merely grinding the top or height dimension (H2) of the mesa to tune the device. (Grinding down the height of the mesa will reduce the effective capacitance, increasing the frequency of the zero.) Since there is no top patterning on the top surface (26), prior art tuning by careful trimming of precise patterns is avoided and instead the tuning is replaced grinding, lapping, or milling operations; operation that can be performed on the entire surface (26) of the mesa.

It can be seen in FIG. 1 that one side of the block (16) on which the input-output pads are located is a side that provides a common side for the both the mesa (26) and the lower portion of the block. As such the mesa (26) in the embodiment shown in FIG. 1 might be considered as having one of its sides co-planar with one side (16) of the lower portion of the block (12). The geometry of the block shown in FIG. 1, with the side-located I/O pads, (36 and 38) readily lends itself to surface mounting onto a substrate. Alternate embodiments might of course include the use of a mesa having four sides, none of which are co-planar with any side or sides of the block (12) however such a structure would not lend itself to surface mount manufacturing, as the device shown in FIG. 1 is intended to do.

Figure 2:
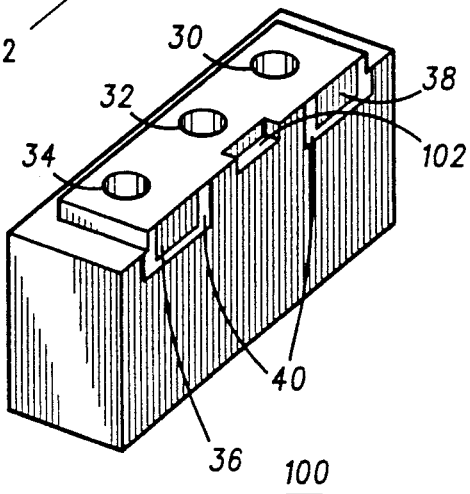
FIG. 2 discloses an alternate embodiment of the structure shown in FIG. 1.

FIG. 2 discloses an alternate embodiment of a ceramic block filter (100) having high side transmission zeroes and no top patterning. In FIG. 2 the ceramic block filter (100) includes side mounted I/O pads (36 and 38) as they are shown in FIG. 1 that are surrounded by unmetallized areas (40), but also includes a loading-/coupling notch (102) located between the two I/O pads (36 and 38) that reduces inter-cell capacitance between the lined holes (30, 32, and 34) as shown in FIG. 2. With the loading/coupling notch (102) as shown in FIG. 2, the center resonator (32) loading will increase and increase the isolation of the outer holes (30 and 34) from each other increasing the relative bandwidth of the passband of the filter somewhat.

Figure 3:
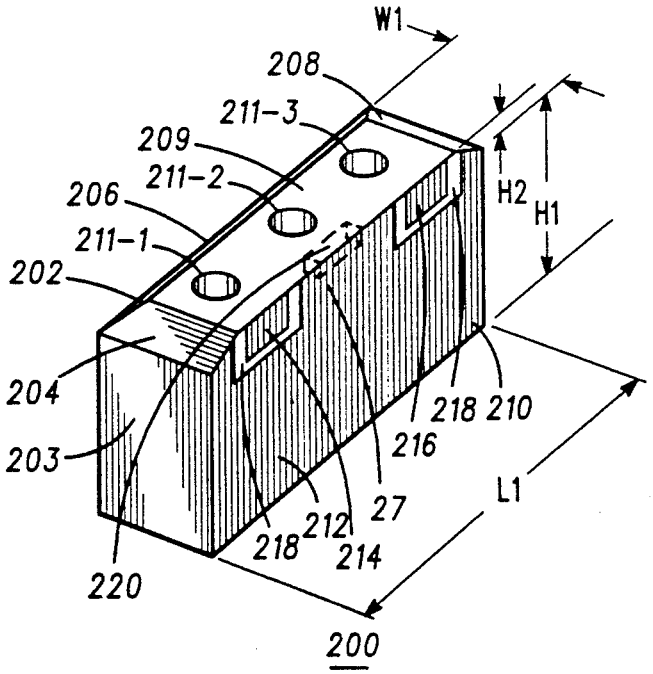
FIG. 3 also shows an alternate embodiment of the structure shown in FIG. 1 whereby a high side transmission zero can be accomplished without top patterning.

FIG. 3 shows yet another embodiment of a ceramic block filter having a high side transmission zero and not using top patterning. The block filter (200) shown in FIG. 3 may be somewhat easier to manufacture in that the mesa as shown in FIG. 1 has been transformed from a substantially parallelepiped-shaped mesa to a somewhat trapezoidal shaped mesa (27). In FIG. 1, a substantially rectangular block of material that comprises the lower portion of the filter has a length L1, a width W1, and a height H1. The lower portion of the block, i.e., the portion below the trapezoidal shaped mesa, can be considered to have at least a bottom surface and four side surfaces, similar to the embodiment shown in FIGS. 1 and 2. The substantially trapezoidal shaped mesa has a top surface (209), and at least three inclined side surfaces (202, 204, and 208) as shown. A single vertical side surface (212) might be considered as being co-planar with a side surface of the lower portion of the block.

Three holes (211-1, 211-2, and 211-3) extend through the mesa and the rectangular section of the block, and like the exterior surfaces of the block, are coated with a metallization layer (203). As shown in FIGS. 1 and 2, separate input/output pads (214 and 216) that are metallization layers isolated from the exterior metallization of the block (203) by cutback areas (218) provide a means for coupling signals into and out of the filter. These input/output pads (214 and 216) are located on the side surface (212). The mesa in FIG. 3 has a height H2 providing a total of overall block height equal to H1 plus H2.

Figure 4:
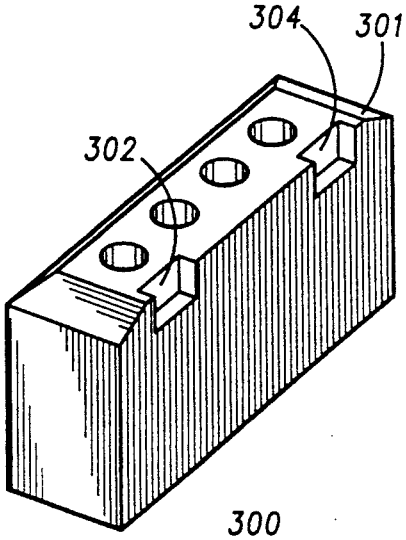
FIG. 4 shows yet another embodiment of a ceramic block filter having a high transmission zero without using top patterning.

An alternate embodiment of the structure shown in FIG. 3 would include an addition of the loading/coupling notch shown by the broken lines and identified by (220) which perform the same function as the loading-/coupling notch (102) shown in FIG. 2. Still another alternate embodiment would be that of the structure shown in FIG. 4 that includes a ceramic block filter (300) that has a trapezoidal shaped mesa but also includes first and second metallized recesses (302 and 304) in one side of the block, provides a method and apparatus for coupling signals into and out of the filter. These recesses (302 and 304) can be considered to be input-/output pads that also would have increased capacitive coupling to the top or open circuited end of the metallized holes in the block.

Using any of these structures disclosed herein, a ceramic block filter can be provided that has a bandpass characteristic with so-called high transmission zeroes (zeroes in the transfer function that are above the frequency of the passband and that accomplish a suppression of undesired signals above the passband frequency). The blocks can be bulked tuned by milling off, grinding, or otherwise removing portions of the mesa that is formed when the block is initially pressed during its initial fabrication that eliminates the need for precise and difficult to tune top patterning.

By providing additional loading/coupling notches in the mesa areas the coupling to ground of the middle or intermediate stage can be increased providing a more increased or wider passband that can also be tuned by milling the mesa from the top downward.

What is claimed is:

1. A side-step ceramic block filter comprised of:

a substantially rectangular block of ceramic material having a first length L1, a width, W1, and a first height, H1, said rectangular block having a substantially planar first top, bottom and four side surfaces, at least three of said side surfaces having a height substantially equal to H1;

a substantially parallelepiped-shaped mesa having a second (i) top surface and (ii) at least four side surfaces and formed of said ceramic material, located on said first top surface of said block, said mesa having a height H2 less than H1, and having a width W2 less than W1, and a length L2 less than L1, at least one of said second side surfaces of the mesa and at least one of said first side surfaces of said rectangular block are substantially co-planar defining a substantially co-planar surface and having a combined height equal to H2 and H1;

at least two resonator holes extending through said substantially rectangular block of ceramic material and through said mesa;

a metallization layer coating said first top, bottom, and four side surfaces of said rectangular block and said at least four side surfaces of said mesa, excluding the second top surface of said mesa, but including inner surfaces of said resonator holes, said metallization layer of said resonator holes being electrically coupled to said metallization on said bottom surface of said rectangular block; and first and second input/output pads located on said co-planar surface, electrically isolated from metallization on said co-planar surface and located proximate to said second top surface.

2. The ceramic block filter of claim 1 further comprised of said mesa having at least one loading/coupling notch formed between said first and second input/output pads.

3. The ceramic block filter of claim 1 wherein said first and second input/output pads comprised of first and second metallized recesses on said co-planar surface located proximate to said second top surface.

4. A side-step ceramic block filter comprised of:

a substantially rectangular block of ceramic material having a first length L1, a width, W1, and a first height, H1, said rectangular block having a substantially planar first top, bottom and four side surfaces, at least three of said side surfaces having a height substantially equal to H1;

a substantially trapezoidal-shaped mesa having a second top surface and at least three inclined side surfaces and formed of said ceramic material, located on said first top surface of said block, said mesa having a height H2 less than H1, and having a width W2 less than W1, and a length L2 less than L1, at least one of said second side surfaces of the mesa and at least one of said first surfaces of said rectangular block are substantially co-planar defining a substantially co-planar surface;

at least two resonator holes extending through said substantially rectangular block of ceramic material and through said mesa;

a metallization layer coating said first top, bottom, and four side surfaces of said rectangular block said at least three inclined side surfaces of said mesa, excluding the second top surface of said mesa but including inner surfaces of said resonator holes, said metallization layer of said resonator holes being electrically coupled to said metallization on said bottom surface of said rectangular block; and first and second input/output pads located on said co-planar surface, electrically isolated from metallization on said co-planar surface and located proximate to said second top surface.

5. The ceramic block filter of claim 4 wherein said substantially co-planar surface has a combined height equal to H2 plus H1.

6. The ceramic block filter of claim 4 further comprised of said mesa having at least one loading/coupling notch formed between said first and second input/output pads.

7. The ceramic block filter of claim 4 wherein said first and second input/output pads comprised of first and second metallized recesses on said co-planar surface located proximate to said second top surface.

* * * * *